United States Patent [19]

Wiand et al.

[11] Patent Number: 4,914,865

[45] Date of Patent: Apr. 10, 1990

[54] CYLINDER MACHINE WITH IMPROVED SPHERICAL BEARING

[75] Inventors: Ronald C. Wiand, Detroit; Joel M. Selman, Southfield; Scott W. Stay, New Baltimore, all of Mich.

[73] Assignee: The Standard Products Company, Cleveland, Ohio

[21] Appl. No.: 311,450

[22] Filed: Feb. 16, 1989

Related U.S. Application Data

[63] Continuation of Ser. No. 170,669, Mar. 18, 1988, abandoned, which is a continuation of Ser. No. 947,978, Dec. 31, 1986, abandoned, which is a continuation-in-part of Ser. No. 909,476, Sep. 19, 1986, abandoned.

[51] Int. Cl.[4] ..... B24B 13/00

[52] U.S. Cl. ..... 51/55; 51/58; 51/120; 384/906; 403/114; 403/131

[58] Field of Search ..... 51/54, 55, 58, 90, 119, 51/124 L; 277/136; 384/208, 906; 403/114, 115, 131

[56] References Cited

U.S. PATENT DOCUMENTS

| | | | |
|---|---|---|---|
| 300,539 | 6/1884 | Warwick | 51/58 |
| 919,651 | 4/1909 | Spicer | 403/114 X |
| 3,439,964 | 4/1969 | Stone et al. | 384/208 |
| 3,621,613 | 11/1971 | Grob et al. | 51/90 |
| 3,732,647 | 5/1973 | Stith | 51/55 X |

FOREIGN PATENT DOCUMENTS

| | | | |
|---|---|---|---|
| 2645405 | 4/1977 | Fed. Rep. of Germany | 51/119 |
| 67624 | 3/1914 | Switzerland | 51/90 |
| 818549 | 8/1959 | United Kingdom | 403/114 |

*Primary Examiner*—Robert P. Olszewski

*Attorney, Agent, or Firm*—Harness, Dickey & Pierce

[57] ABSTRACT

An apparatus for lapping of ophthalmic lenses has a spherical bearing for supporting a rod, one end of which carries a lapping tool. The spherical bearing has a race and ball through which the rod is fixedly secured. The ball has a generally vertically extending channel facing the race and the race has a guide pin which slidably extends into the channel thus allowing the ball free pivotal but not free rotational movement with respect to the race.

13 Claims, 4 Drawing Sheets

CYLINDER MACHINE WITH IMPROVED SPHERICAL BEARING

RELATED APPLICATION

This is a continuation of United States patent application Ser. No. 170,669, filed Mar. 18, 1988, now abandoned which is a continuation of Ser. No. 947,978 filed 12/31/86, now abandoned, which is a continuation-in-part of Ser. No. 909,476 filed 9/19/86, now abandoned.

BACKGROUND OF THE INVENTION

The present invention relates to an improved bearing and to an abrading apparatus using the bearing. More particularly, the present invention relates to an improved cylinder machine using an improved spherical bearing for the polishing and fining of ophthalmic lenses.

Generally speaking, ophthalmic lenses are initially generated or molded to the approximate curve desired and then finished by fining and polishing on a suitable lapping apparatus. Usually the lens surface is lapped by a cylindrical finisher which moves a lapping tool held in engagement with the lens surface in an irregular path to first fine and then polish the lens. One cylindrical finisher is disclosed in U.S. Pat. No. 3,732,647, May 15, 1973 to Stith.

The Stith apparatus has a vertical rod, the upper end of which supports a lap carrier. The middle of the shaft is pivotally supported by a gimbal assembly and the lower end of the shaft is driven in an orbital motion. The gimbal limits rotation of the shaft about its own longitudinal axis. This is important because the lapping tool at the upper end of the shaft must be maintained in accurate rotational alignment with the surface of the lens to be ground in order to grind compound or cylindrical lenses without axis error. In one aspect, the present invention is in the nature of an improvement of the Stith apparatus which can be achieved by use of a spherical bearing of the present invention instead of the gimbal of the Stith apparatus. The present invention provides a means for correcting machine induced axis error. In addition, the present invention provides an improved support means which can be more easily sealed from the environment, which has less vibration, which requires less maintenance, and which has fewer moving parts than does a gimbal apparatus. These and other advantages of the present invention will become apparent from the accompanying drawings and the following disclosure.

DESCRIPTION OF THE INVENTION

The present invention relates generally to a spherical bearing which allows pivotal movement about any of its horizontal axes while preventing rotation about its vertical axis. The spherical bearing of the present invention is particularly well adapted for use in a polisher-finer machine and is described herein in the context of such a machine.

Figure 1:
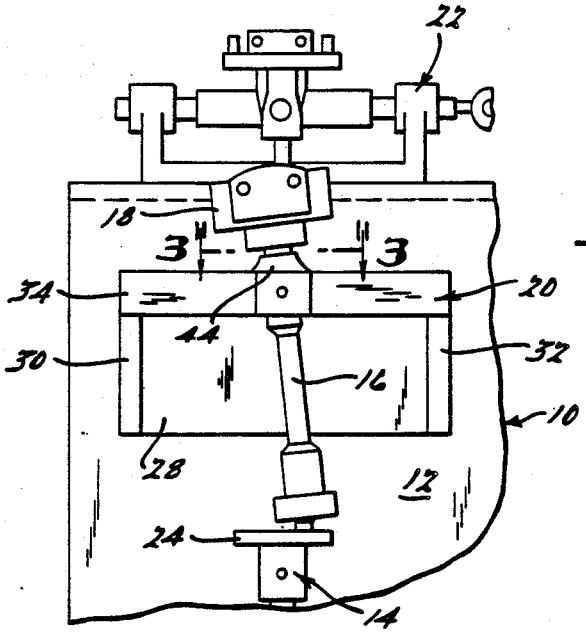
FIG. 1 is a front elevation, broken away, of a preferred embodiment of the present invention.

Now referring to the Figures, FIG. 1 is a front elevation of a polisher-finer apparatus of the present invention, indicated generally by the numeral 10. Polisher-finer apparatus 10 is constructed generally in accordance with U.S. Pat. No. 3,732,647, May 15, 1973 to Stith for "Polisher-Finer Machine" the disclosure of which is specifically incorporated by reference herein. Generally speaking, polisher-finer apparatus 10 includes a framework 12 which supports drive means 14 for moving the lower end of rod 16 to transmit first and second motions to lap carrier 18, a bracket 20 for pivotally supporting the middle portion of rod 16, and reciprocating means 22 for transmitting a third motion to the lens being polished or fined. As is well known to those skilled in the art, drive means 14 causes driver plate to give a combination of movements to the lower end of rod 16, which combination of movements is transmitted to lap carrier 18 by rod 16 which pivots at or near its midpoint. The combination of movements provides an irregular motion between lap carrier 18 and the lens being lapped to avoid grooves or ridges in the lens. However, in order to lap a lens having both a spherical curve and a cylinder curve, i.e. a compound lens, the lap carrier, more specifically, the lapping tool, and the lens must be maintained in parallel relationship. The Stith apparatus employs a gimbal pivot to prevent rotation of the rod supporting the lap carrier and to maintain the lap carrier in substantially parallel relationship to the lens.

The improvement of the present invention relates specifically to the construction and operation of the pivot provided for rod 16 in bracket 20. While the Stith patent employs a gimbal assembly, in accordance with the present invention, the gimbal assembly is replaced by a spherical bearing of the present invention.

Figure 2:
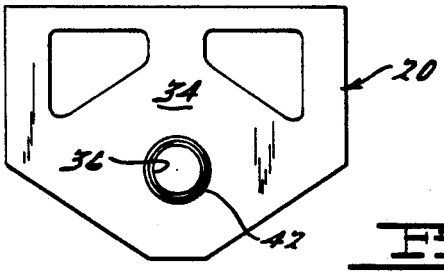
FIG. 2 is a plan view of a bracket for holding a spherical bearing of this invention.
Figure 7:
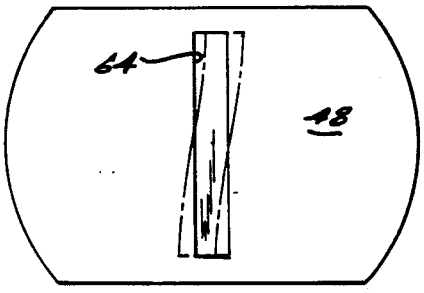
FIG. 7 is a side elevation of a ball of a spherical bearing of the present invention showing the axis correction track.
Figure 5:
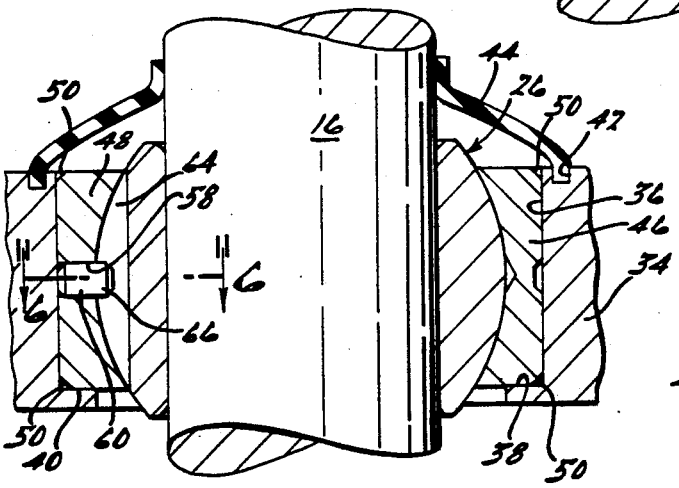
FIG. 5 is a sectional view taken along line 5—5 in FIG. 3.
Figure 6:
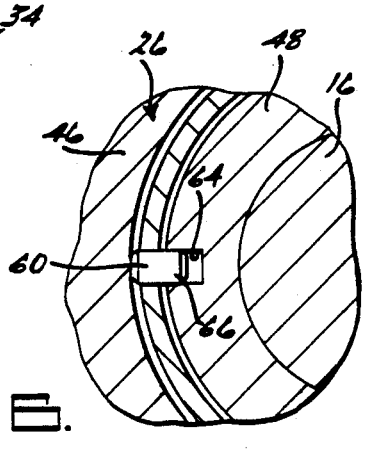
FIG. 6 is a sectional view taken along line 6—6 in FIG. 5.

Thus, rod 16 extends through, and is supported by, spherical bearing 26 which is press fit in bracket 20. Bracket 20 is generally U-shaped in plan view and comprises back plate 28, arms 30 and 32, and wobble plate 34 extending therebetween in a generally horizontal manner. While bracket 20 can comprise separate parts bolted or otherwise secured together, bracket 20 is preferably a single casting as shown in FIGS. 1 and 2. Wobble plate 34 has a central bore 36 sized to tightly receive spherical bearing 26 with shoulder 38 acting as a stop against the lower face 40 of bearing 26 as shown in FIG. 5. Wobble plate 34 also has an annular channel 42 for receiving and holding an edge portion of rubber seal 44.

As is best shown in FIGS. 3-7, spherical bearing 26 broadly comprises race 46 and ball 48. In normal use, ball 48 can freely pivot about any horizontal axis, but not rotate about the vertical axis, with respect to race 46. Alternatively, ball 48 can freely pivot, but selectively rotate, with respect to race 46.

Race 46 has chamferred edges 50 and is press fit into bore 36 of wobble plate 34 with face 40 against shoulder 38 of wobble plate 34. Race 46 has a first cylindrical bore 52 which allows access to pin 54 so that pin 54 can be driven to tightly fit in bore 56 in ball 48. Race 46 also has a second cylindrical bore 58 into which axis guide pin 60 is tightly fit.

Ball 48 has a cylindrical aperture 56 into which one end portion of pin 54 tightly fits. The other end portion of pin 54 tightly fits into bore 62 of rod 16 thereby locking together rod 16 and ball 48. Bore 62 extends through rod 16 to allow removal of pin 54 by first driving pin 54 to the left as viewed in FIG. 4, removing rod 16 from ball 48 and then driving pin 54 out of rod 16 either to the left or right. Ball 48 also has a vertically extending slot 64 into which end portion 66 of pin 60 slidably extends to cooperate with slot 64 to allow horizontal pivotal movement of ball 48 in race 46 but to prevent rotation of ball 48 in race 46 about the vertical axis, i.e. the vertical or longitudinal axis of rod 16.

In operation, spherical bearing 26 allows pivotal movement of rod 16 about any horizontal axis extending through the center of spherical bearing 26 but controls rotational movement of rod 16 about its longitudinal axis by means of vertical channel or slot 64. Thus, slot 64 can be cut in an arcuate shape as shown in dashed lines in FIG. 7 to cause rotational movement of rod 16 when pivotal movement occurs and guide pin 60 slides along slot 64. Thus, machine or other error causing lap carrier 18 to go off axis can be corrected by selectively cutting slot 64.

Figure 3:
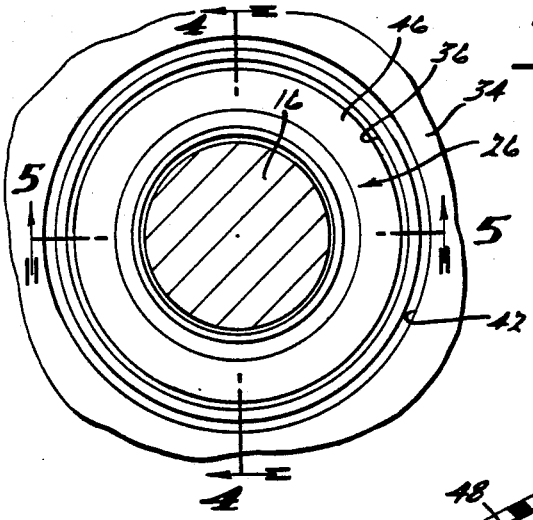
FIG. 3 is a sectional view taken along line 3—3 in FIG. 1.
Figure 4:
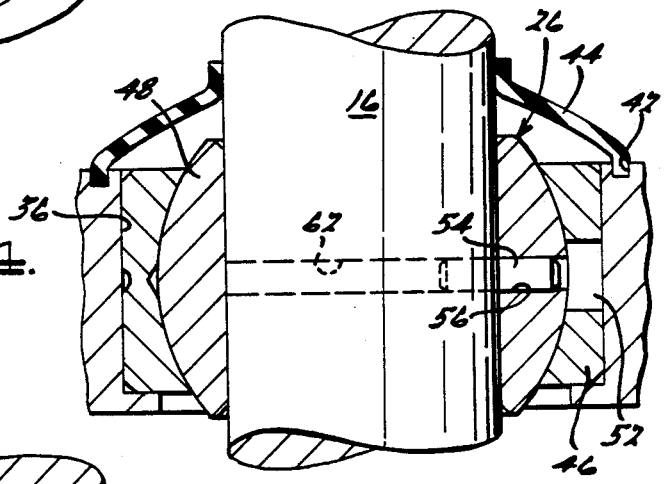
FIG. 4 is a sectional view taken along line 4—4 in FIG. 3.
Figure 8:
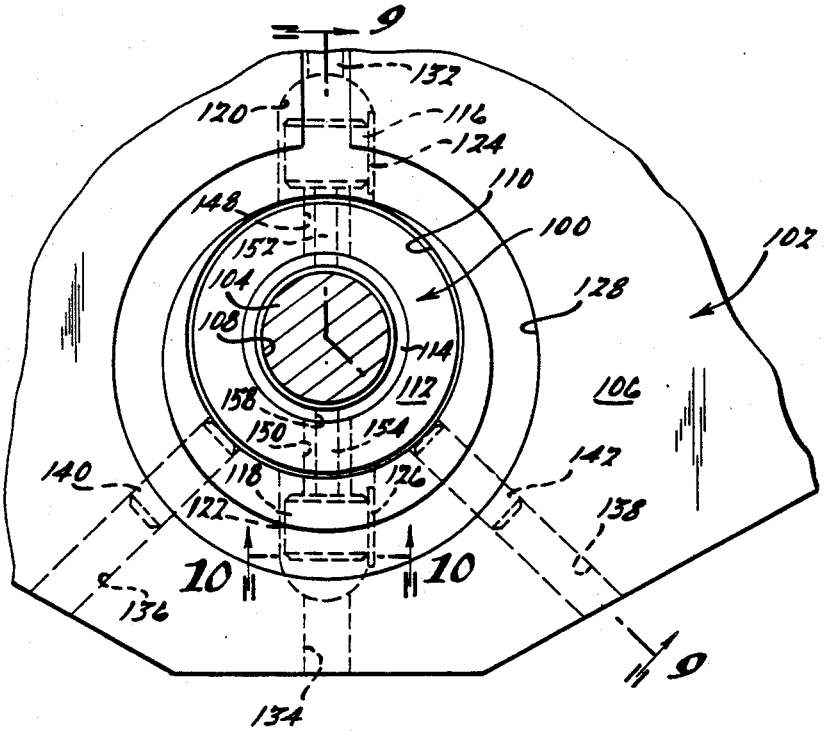
FIG. 8 is a sectional view, broken away, similar to FIG. 3 but showing an alternative preferred embodiment of the present invention.
Figure 9:
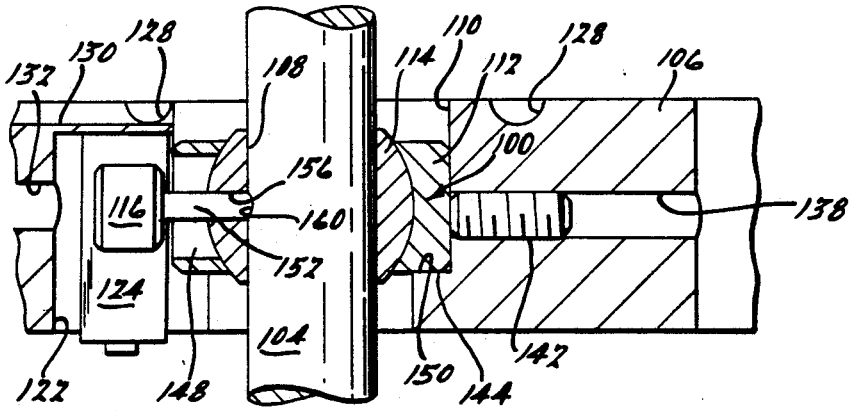
FIG. 9 is a sectional view, broken away, taken along line 9—9 in FIG. 8.
Figure 10:
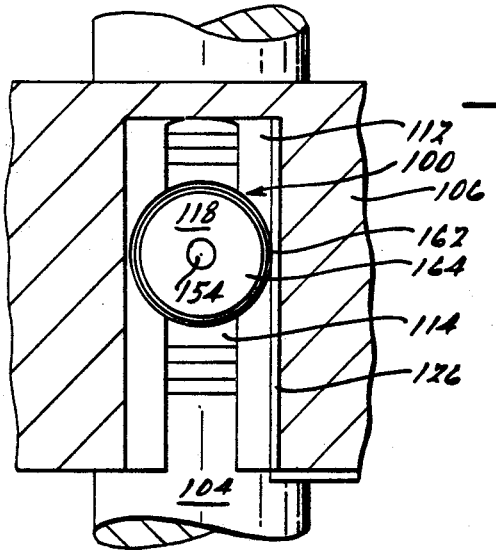
FIG. 10 is a sectional view, broken away, taken along line 10—10 in FIG. 8.

Now referring to FIGS. 8-10, an alternative preferred spherical bearing of the present invention is shown and indicated generally by the numeral 100. Spherical bearing 100 is shown in operative association with polisher-finer apparatus 102 which is generally analogous to polisher-finer apparatus 10 of FIGS. 1-7. FIG. 8 is a view, similar to FIG. 3, showing tool post, or rod 104 in section and wobble plate 106 and spherical bearing 100 in plan view. Rod 104 extends through bore 108 of spherical bearing 100 which itself fits into bore 110 of wobble plate 106.

Spherical bearing 100 comprises a race 112 and a ball 114 which are generally analogous to bearing 26 except that spherical bearing 100 has modified means for preventing rotation about the vertical axis of rod 104. The means for preventing rotation about the vertical axis of rod 104 which, of course, is also the vertical axis of spherical bearing 100, includes a pair of roller guide bearings 116 and 118 in vertically extending slots 120 and 122. Roller guide bearings 116 and 118 abut against wear plates 124 and 126 respectively and cooperate therewith to selectively control the rotation, if any, of ball 114 about the longitudinal axis of rod 104.

Wobble plate 106 has an annular drainage channel 128 in its top surface portion. Drainage channel 128 is in fluid communication with straight drainage channel 130 and cooperates therewith for the purpose of draining any abrasive slurry which might leak down onto wobble plate 106 away from bearing 100. Further protection of bearing 100 can be had from a protective seal, analogous to the rubber seal 44 of spherical bearing 26 which is preferably also employed in the present invention but is not shown in FIGS. 8-10. Vertically extending slots 120 and 122 extend towards the top of wobble plate 106 a distance to allow the desired vertical movement of roller bearings 116 and 118 and, hence, the desired pivotal movement of ball 114 about any horizontal axis through the center of spherical bearing 100. Slots 120 and 122 extend to the bottom of wobble plate 106 to thereby provide openings through which roller bearings 116 and 118 can be installed. Wobble plate 106 has bores 132 and 134 which communicate with slots 120 and 122 and allows access to the outboard ends of roller bearings 116 and 118. Additional bores 136 and 138 in wobble plate 106 allow access to set screws 140 and 142 which are threadably secured therein and which clamp race 112 within bore 110.

Race 112 is slidably fit into bore 110 of wobble plate 106 with lower face 144 resting against shoulder 150 of wobble plate 106. Race 112 is selectively fixedly secured within wobble plate 106 by means of set screws 140 and 142. Race 112 has vertical slots 148 and 150 to freely accommodate axles 152 and 154 of roller bearings 116 and 118.

Ball 114 has a vertically extending bore 108 through which rod 104 extends. Rod 104 is attached to ball 114 by means of axles 152 and 154 which are threadably secured in bores 156 and 158 in ball 114 and tightly fit in depressions in rod 104, depression 160 being shown in FIG. 9.

Roller guide bearing 118 comprises an outer race 162 which turns about ball 164 and has an axle 154 for attachment to ball 114. As mentioned above, axle 154 also secures rod 104 to ball 114. Roller guide bearing 116 is of analogous construction.

Operation of spherical bearing 100 is similar to that of spherical bearing 26. Thus, ball 114 freely pivots about any horizontal axis therethrough, within limits, but has selected rotational movement about the longitudinal axis of rod 104 as a result of roller guide bearings 116 and 118 which bear against wear plates 124 and 126 to control rotation of ball 114 and, hence, rod 104. Wear plates 124 and 126 can, of course, be constructed at a desired vertical angle to provide the desired degree of rotation to maintain the lap carrier on rod 104 "on axis."

Figure 11:
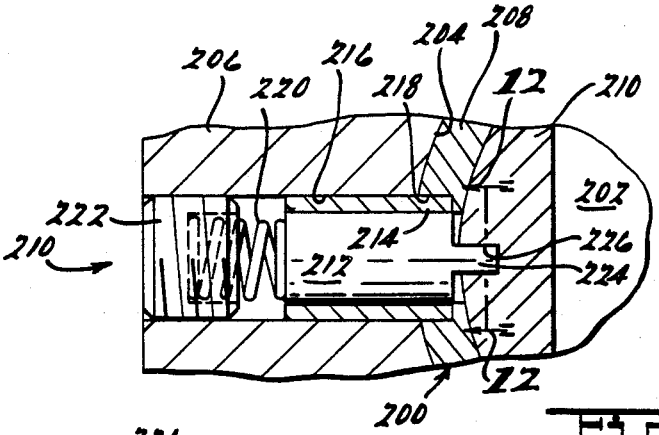
FIG. 11 is a sectional view, broken away, similar to FIG. 4 but showing another alternative preferred embodiment of the present invention.
Figure 12:
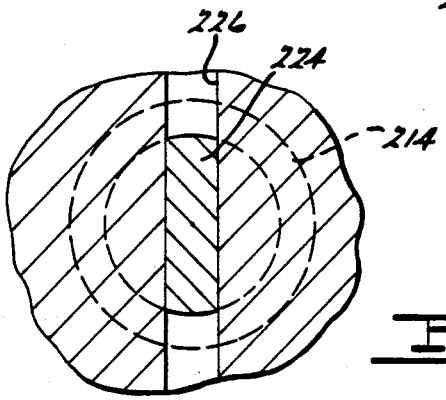
FIG. 12 is a sectional view, broken away, taken along line 12—12 in FIG. 11.

Yet another alternative embodiment of the present invention is shown in FIGS. 11-12 and indicated generally by the numeral 200. Spherical bearing 200 is generally analogous to spherical bearing 26 but incorporates an alternative means for selectively controlling rotation about the longitudinal axis of rod 202. Thus, spherical bearing 200 fits into bore 204 of wobble plate 206 and generally comprises a race 208 and ball 210. Means for selectively controlling rotation about the longitudinal axis of rod 202 is indicated generally by the numeral 210 and comprises a pin 212 which slidably fits into bushing 214 which is press fit into bore 216 in wobble plate 206 and bore 218 in race 208. Pin 212 is biased rightward as viewed in FIG. 11 by coil spring 220 which is held in bore 216 by threaded cap 222. The inward end of pin 212 has a flat projection 224 which is slidably fit into vertical slot 226 in ball 210. Thus, ball 210 has free pivotal movement, up to a selected amount, with the flat projection 224 sliding upwardly and downwardly in slot 226 and pin 212 rotating within bores 216 and 218. However, rotation of ball 210 is selectively controlled by slot 226 in cooperation with flat projection 224.

Thus, the operation of spherical bearing 200 is similar in effect to that of spherical bearings 26 and 100 in providing selective control of rotation of the bearing about its vertical axis.

It will be appreciated by those skilled in the art that the use of a spherical bearing of the present invention offers several advantages. First of all, the spherical bearing can be sealed by a suitable seal such as seal 44 to prevent water and abrasive flowing down into the working parts of the bearing. In contrast to a gimbal arrangement, the spherical bearing can thus be easily sealed from the environment. In addition, the spherical bearing provides axis correction means to allow substantially error-free axis polishing and fining when used in conjunction with a cylinder machine.

It will be appreciated that while preferred embodiments of the present invention have been described herein, the present invention is subject to modification and variation by the skilled artisan. For example, the slot and guide pin arrangement of the first embodiment of the present invention could be provided with the slot in the race and the guide pin in the ball. These and other modifications are contemplated to be within the scope of the present invention which is to be limited only by the following claims.

What is claimed is:

1. An apparatus for lapping a curved surface of an ophthalmic lens or the like comprising:

an elongated rod;

lapping means supported on one end portion of said rod;

a spherical bearing pivotally supporting a middle portion of said rod;

drive means for imparting movement to said abrading means;

said spherical bearing having a race and a ball pivotally supported in said race, one of said ball and race having an elongated channel therein, the other of said ball and race having a guide pin slidably extending into said channel, said channel and guide pin cooperating to allow pivotal movement of said ball with respect to said race about one axis but only selected rotational movement therebetween about another axis to compensate for rotational deviation from said another axis caused by said pivotal movement.

2. An apparatus as in claim 1 wherein said one axis is a horizontal axis, said other axis is a generally vertical axis and said channel is a generally vertical extending channel.

3. An apparatus as in claim 2 wherein said ball has a central bore through which said elongated rod extends, said rod being fixedly secured to said ball.

4. An apparatus as in claim 3 wherein said channel is in said ball and said guide pin is fixedly secured in said race and slidably extends into said channel in said ball.

5. An apparatus as in claim 4 wherein said apparatus includes a seal extending from said race to said rod and sealing said spherical bearing.

6. An apparatus as in claim 5 wherein said channel extends along a straight line.

7. An apparatus as in claim 5 wherein said channel extends along an arcuate line.

8. An apparatus as in claim 1 wherein said ball has a vertically extending elongated channel and said guide pin has a forward end portion having flat sides slidably disposed in said elongated channel, said guide pin being rotatably positioned in a bore in said race.

9. An apparatus as in claim 8 wherein said guide pin is spring biased towards said ball.

10. An apparatus as in claim 8 wherein said bore has a sleeve rotatably receiving said guide pin.

11. An apparatus for lapping a surface of an ophthalmic lens or the like comprising:

an elongated tool post having opposite end portions;

lapping means for abrading said surface, said lapping means being supported on one end portion of said tool post;

a spherical bearing pivotally supporting a middle portion of said tool post;

a support bracket supporting said spherical bearing; drive means for imparting movement to another end portion of said tool post;

said spherical bearing having a race and a ball pivotally supported in said race, said support bracket having at least one vertically elongated channel therein with a roller guide bearing positioned in said channel, said roller guide bearing being operatively connected to said ball so that pivotal movement of said ball causes movement of said guide bearing in said channel, said operative connection allowing limited pivotal movement of said ball with respect to said race about any horizontal axis therethrough but selectively controlled rotation of said ball about the vertical axis to compensate for rotational deviation about said vertical axis caused by said pivotal movement.

12. An apparatus as in claim 11 wherein said race has a vertically elongated slot through which an axle of said roller guide bearing freely extends.

13. An apparatus as in claim 12 wherein each said slot in said support bracket has a wear plate against which each said guide bearing bears.

* * * * *

UNITED STATES PATENT AND TRADEMARK OFFICE

CERTIFICATE OF CORRECTION

PATENT NO. : 4,914,865

DATED : April 10, 1990

INVENTOR(S) : Ronald C. Wiand, Joel M. Selman & Scott W. Stay

It is certified that error appears in the above-identified patent and that said Letters Patent is hereby corrected as shown below:

ON TITLE PAGE:

Assignee:
"The Standard Products Company" should be
--Inland Diamond Products Company--.

Abstract, line 4, after "and" insert --a--.

Column 5, line 44, "from" should be --about--.

Column 5, line 48, "vertical" should be --vertically--.

Signed and Sealed this

Third Day of December, 1991

*Attest:*

HARRY F. MANBECK, JR.

*Attesting Officer*

*Commissioner of Patents and Trademarks*